US008210827B2

(12) United States Patent
Parrett et al.

(10) Patent No.: US 8,210,827 B2
(45) Date of Patent: Jul. 3, 2012

(54) SANITARY PUMP ASSEMBLY

(75) Inventors: Dale H. Parrett, Springboro, OH (US); Adam C. Downey, Beavercreek, OH (US); Jeffrey Ellinger, Springfield, OH (US)

(73) Assignee: Moyno, Inc., Springfield, OH (US)

( * ) Notice: Subject to any disclaimer, the term of this patent is extended or adjusted under 35 U.S.C. 154(b) by 1006 days.

(21) Appl. No.: 11/928,929

(22) Filed: Oct. 30, 2007

(65) Prior Publication Data

US 2009/0110565 A1 Apr. 30, 2009

(51) Int. Cl.
*F04B 23/08* (2006.01)

(52) U.S. Cl. ..... 417/205; 417/244; 417/900; 418/48; 418/179

(58) Field of Classification Search ..... 418/48, 418/166, 171, 178, 179; 417/203, 205, 244, 417/900

See application file for complete search history.

(56) References Cited

U.S. PATENT DOCUMENTS

| | | | | |
|---|---|---|---|---|
| 1,459,713 | A * | 6/1923 | Beggs | 241/38 |
| 2,512,764 | A | 6/1950 | Byram | |
| 2,612,845 | A | 10/1952 | Byram et al. | |
| 2,631,761 | A | 3/1953 | Gates | |
| 2,658,604 | A * | 11/1953 | Erdmenger et al. | 222/226 |
| 3,590,652 | A | 7/1971 | Strang | |
| 4,221,507 | A * | 9/1980 | Olney | 222/55 |
| 4,248,554 | A | 2/1981 | Boucher et al. | |
| 4,452,547 | A | 6/1984 | Thiel et al. | |
| 4,494,290 | A | 1/1985 | Rutledge | |
| 5,122,038 | A * | 6/1992 | Malkoski | 417/313 |
| 5,197,345 | A | 3/1993 | Rose | |
| 5,558,473 | A * | 9/1996 | Lindahl | 406/61 |
| 5,722,820 | A | 3/1998 | Wild et al. | |
| 6,120,267 | A | 9/2000 | Cunningham | |
| 6,485,023 | B2 | 11/2002 | Budrow et al. | |
| 6,491,501 | B1 | 12/2002 | Wild et al. | |
| 6,648,501 | B2 * | 11/2003 | Huber et al. | 366/301 |
| 6,834,862 | B2 | 12/2004 | Wilkinson | |
| 2005/0133625 | A1 * | 6/2005 | McLeod | 418/48 |

* cited by examiner

*Primary Examiner* — Theresa Trieu
(74) *Attorney, Agent, or Firm* — Thompson Hine LLP

(57) ABSTRACT

A progressing cavity pump system including a feeder assembly including a hopper for receiving material to be pumped therein. The feeder assembly includes an auger housing receiving an auger therein. The auger housing has an underlying portion positioned generally below the hopper and having a radial opening open to the hopper, and an extension portion which is generally radially closed. The extension portion and the underlying portion are of a one-piece, seamless construction. The pump system further includes a progressing cavity pump including a rotor, a stator, an inlet and an outlet. The rotor is rotationally disposed inside the stator such that rotation of the rotor causes material in the pump to be pumped from the inlet toward the outlet, and the inlet is fluidly coupled to the extension portion.

26 Claims, 13 Drawing Sheets

SANITARY PUMP ASSEMBLY

The present invention is directed to pump assembly, and more particularly, to a sanitary pump assembly which can pump viscous materials.

BACKGROUND

Progressing cavity pumps may be used in various industries to pump materials such as solids, semi-solids, fluids with solids in suspension, highly viscous fluids and shear sensitive fluids, including chemicals, oil, sewage, or the like. A typical progressing cavity pump (also known as a helical gear pump) includes a rotor having one or more externally threaded helical lobes which cooperate with a stator having an internal bore extending axially therethrough. The bore includes a plurality of helical grooves that forms a plurality of cavities with the stator. As the rotor turns within the stator, the cavities progress from the suction end of the pump to the discharge end of the pump. A feeder assembly, such as a twin-screw feeder, may feed the material to the pump.

SUMMARY

In one embodiment the present invention is a progressing cavity pump for use in sanitary applications. A twin-screw feeder may be utilized to feed the product to the progressing cavity pump.

More particularly, in one embodiment the present invention is a progressing cavity pump system including a feeder assembly including a hopper for receiving material to be pumped therein. The feeder assembly includes an auger housing receiving an auger therein. The auger housing has an underlying portion positioned generally below the hopper and having a radial opening open to the hopper, and an extension portion which is generally radially closed. The extension portion and the underlying portion are of a one-piece, seamless construction. The pump system further includes a progressing cavity pump including a rotor, a stator, an inlet and an outlet. The rotor is rotationally disposed inside the stator such that rotation of the rotor causes material in the pump to be pumped from the inlet toward the outlet, and the inlet is fluidly coupled to the extension portion.

DETAILED DESCRIPTION

Figure 1:
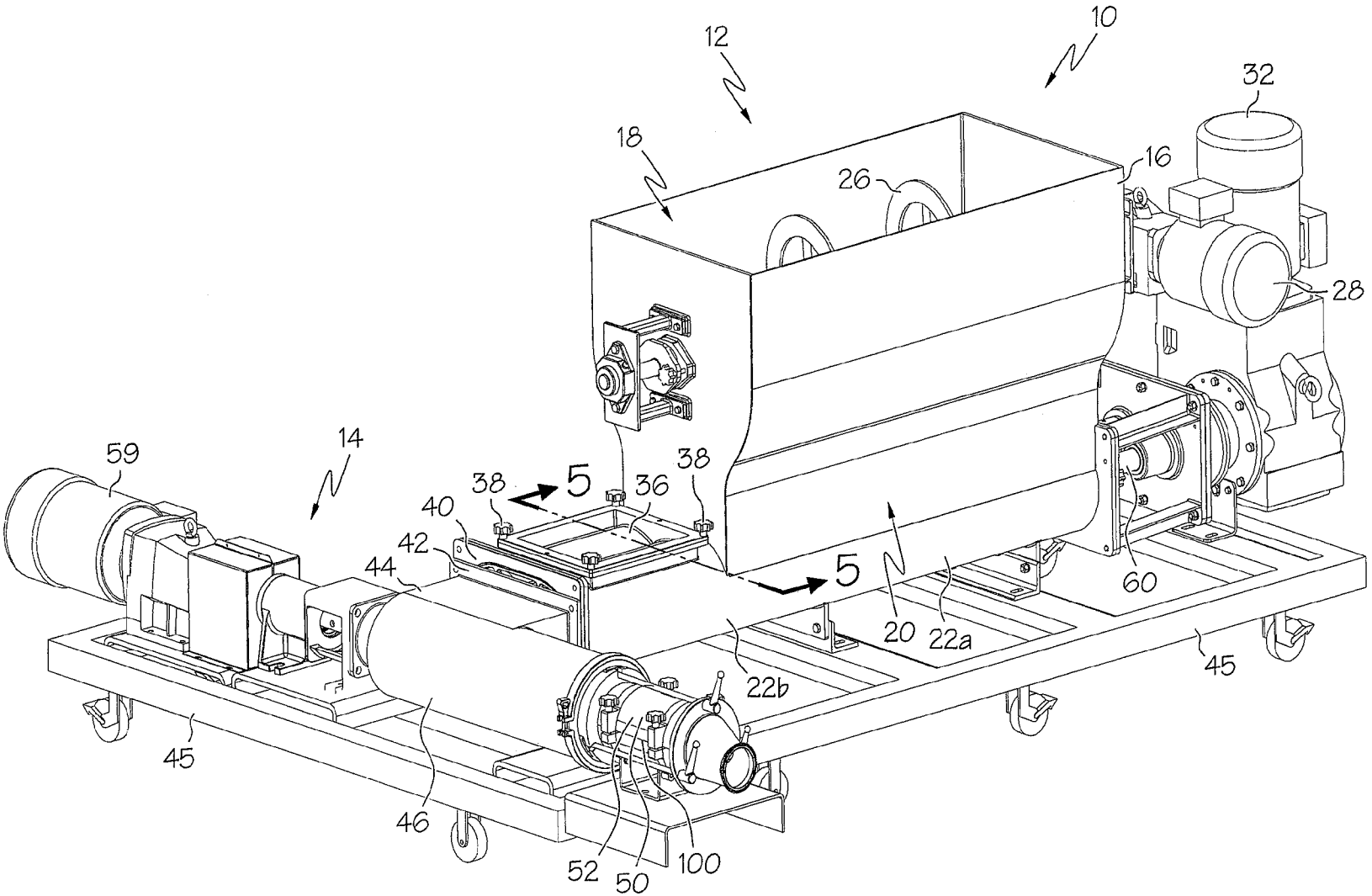
FIG. 1 is a front perspective view of one embodiment of the pump assembly of the present invention.

As shown in FIG. 1, in one embodiment the pump assembly or system 10 includes a feeder assembly 12 for receiving the materials to be pumped. After receiving the materials to be pumped the feeder assembly 12 advances the materials to a progressing cavity pump 14 which pumps the materials therethrough. The pump assembly 10 may be a sanitary pump assembly and therefore may be configured to pump/process foods, food additives and other materials for human or animal consumption, although the pump assembly 10 can also be used to pump various other materials. Moreover, the pump assembly 10 may be configured to pump/process relatively viscous materials, such as cream cheese, processed meats, etc., although the pump assembly 10 may be able to pump/process other materials, including medium and low viscosity materials.

Figure 4:
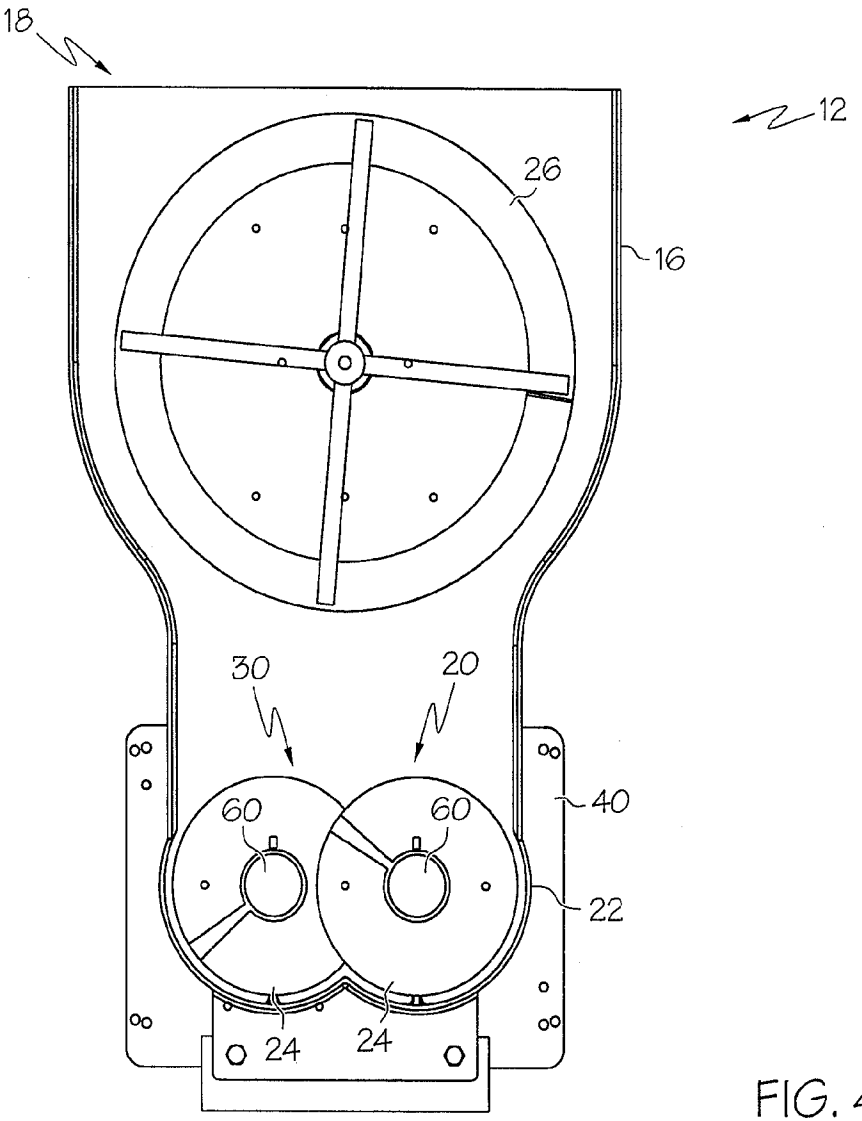
FIG. 4 is a cross section of the feeder assembly, taken along the plane defined by lines 4-4 of FIG. 3.

The feeder assembly 12 includes an elongated hopper 16 which is open at its top 18 and bottom ends 20 (the open bottom end 20 also being termed a lower opening 20 herein). The hopper 16 maybe relatively wide at its top end 18 to increase its capacity and tapers down to a narrower width at its bottom end 20. The open bottom end 20 is fluidly connected to an auger housing 22 which houses a pair of augers 24 therein (see FIG. 4). A ribbon auger 26 is positioned in the hopper 16 and rotatably driven about its central axis by a motor 28. The ribbon auger 26 helps to evenly distribute material in the hopper 16 and evenly provide material to the auger housing 22. In particular, the ribbon auger 26 is driven is a direction opposite to the augers 24 to evenly distribute the material to be pumped and prevent bridging (i.e. a hollowing out) of the material in the hopper 16.

The auger housing 22 includes an upper opening 30 (FIG. 4) which communicates with the open bottom end 20 of the hopper 16 to receives materials therein. One of the augers 24 may a right-hand auger and the other auger 24 may be a left hand auger. The augers 24 are arranged in parallel and may intermesh to ensure there are no dead spots within the auger housing 22. However, if desired the augers 24 may be spaced apart such that they do not intermesh.

The augers 24 are counter-rotatably driven by a drive motor 32. In the illustrated embodiment, the motor 32 driving the augers 24 is different from the motor 28 driving the ribbon auger 26. However, if desired, the same motor may be utilized to drive both the augers 24 and the ribbon auger 26, although in this case gearing may need to be implement to drive the augers 24 and ribbon auger 26 at differing rotational speeds.

The auger housing 22 includes an underlying portion 22*a* positioned below the hopper 16, and an extension portion 22*b* that is not positioned below the hopper 16 and extends beyond the lower opening 20 of the auger housing 22. The extension portion 22*b* lacks any radially-positioned openings (i.e. such as the radially positioned lower opening 20 of the underlying portion 22*a*), and therefore is generally closed and allows pressure to be generated therein.

The extension portion 22*b* may be integrally coupled to underlying portion 22*a* of the auger housing 22. For example, the extension portion 22*b* may be permanently coupled to the underlying portion 22*a* (i.e. by welding or the like), or the underlying 22*a* and extension 22*b* portions may be formed as a unitary, one-piece (i.e. molded) seamless item. By permanently or integrally or non-removably forming the extension portion 22*b* with the underlying portion 22*a*, seams and other points of connection in the internal surface of the auger housing 22 are reduced. This reduces the chances of leakage, eliminates seals and part count, reduces the size of the assembly 12. This connection also creates a smooth inner surface which reduces/eliminates areas in which the pumped materials may be trapped to provide a sanitary transition between the underlying portion 22*a* and the extension portion 22*b*. The unitary/one-piece extension portion 22*b* also makes the feeder assembly specially designed for use with the pump 14.

Figure 5:
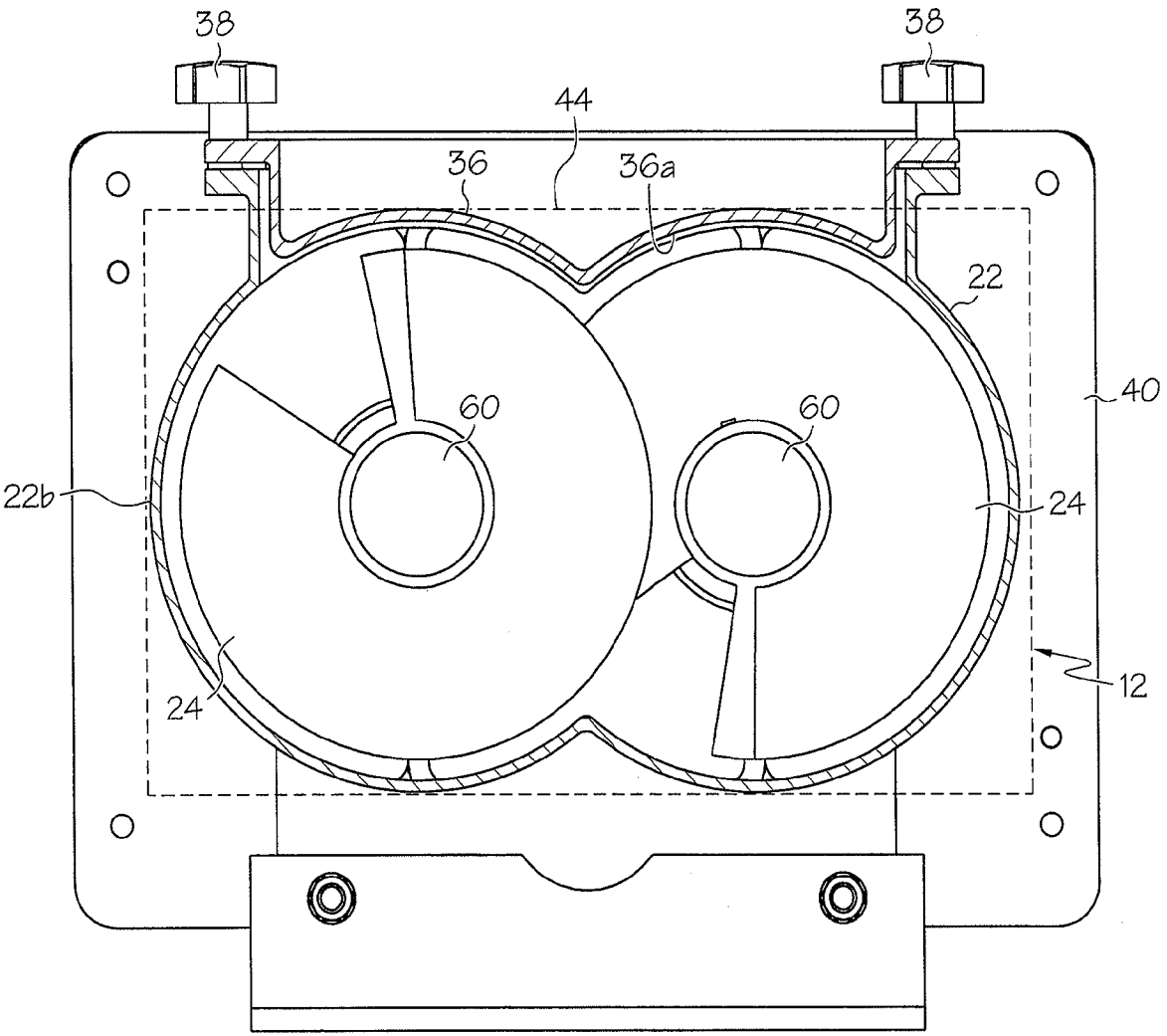
FIG. 5 is a cross section of the feeder assembly, taken along the plane defined by lines 5-5 of FIG. 1.

As shown in FIG. 5, the extension portion 22*b* (or its inner surface) may be generally shaped in end view as two intersecting circles to generally conform the extension portion 22*b* to the augers 24 received therein. Conforming the extension portion 22*b* in this manner helps to eliminate crevices and dead spaces, and also allows greater pressures to be developed to provide positive pressure and flow into the pump 14, which improves the volumetric efficiency of the pump 14 by positively filling the pumping cavities of the progressing cavity pump 14.

Figure 2:
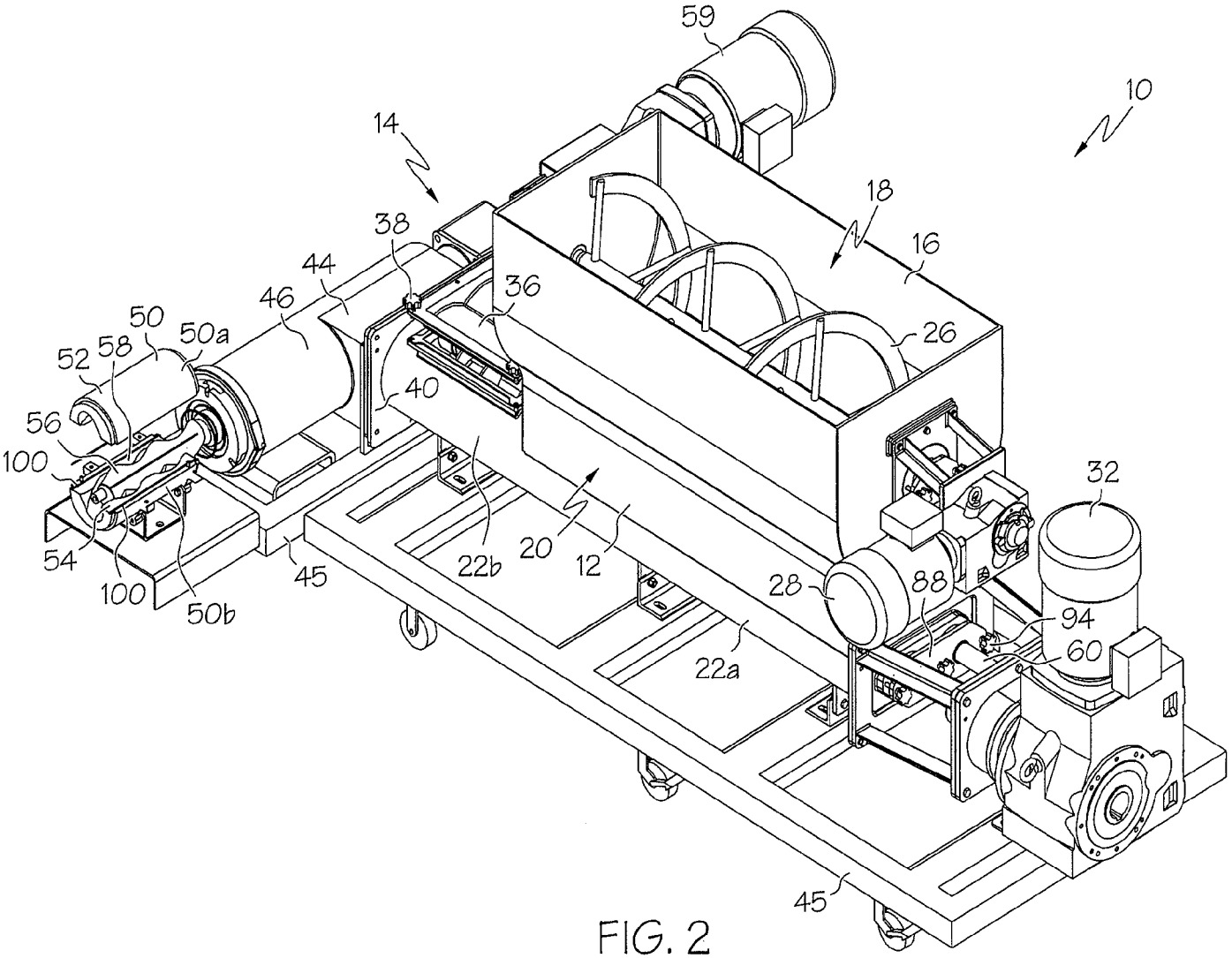
FIG. 2 is a rear perspective view of the pump assembly of FIG. 1, with part of the stator exploded away.
Figure 3:
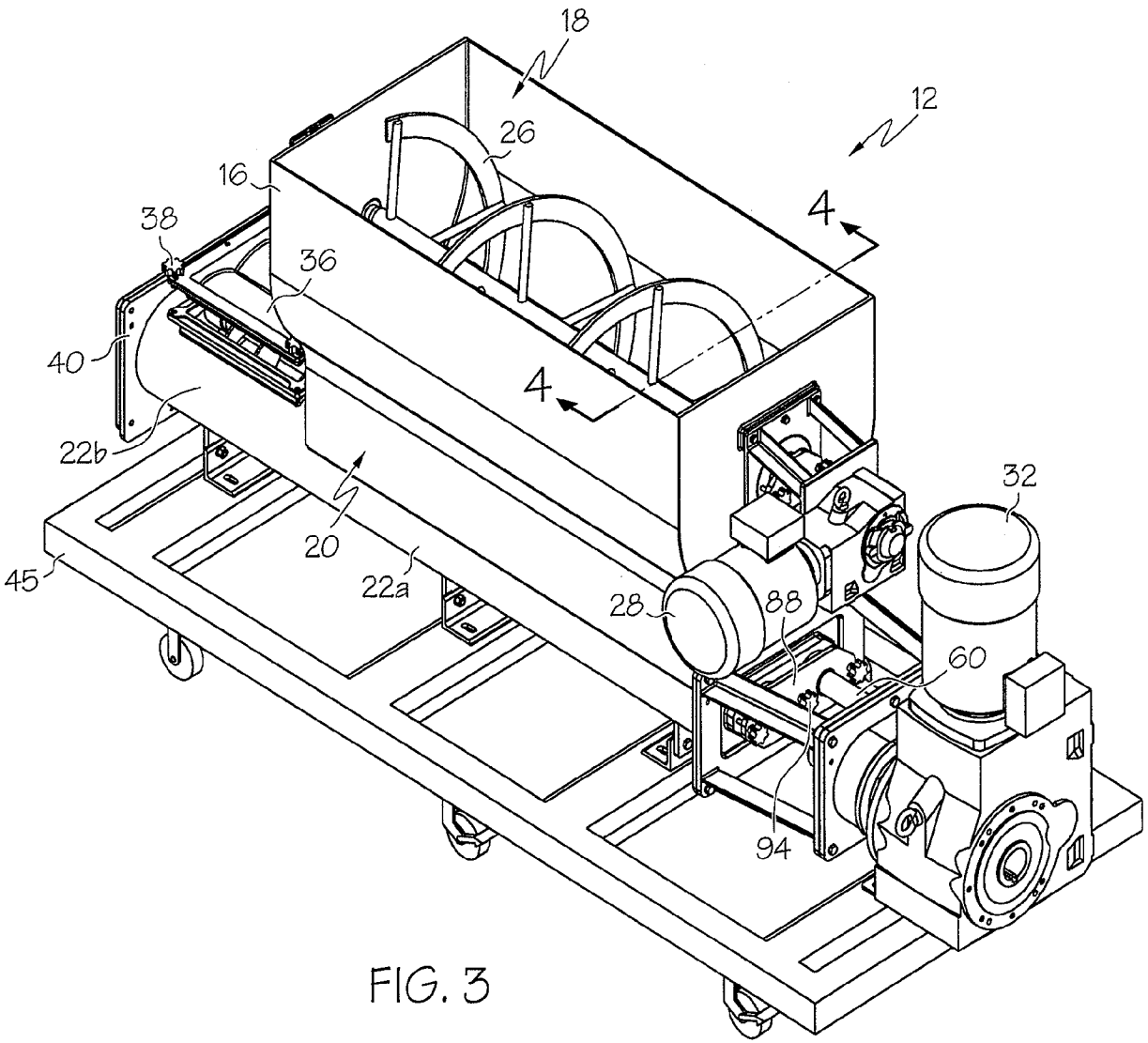
FIG. 3 is a rear perspective view of the feeder assembly of the pump assembly of FIG. 2.
Figure 6:
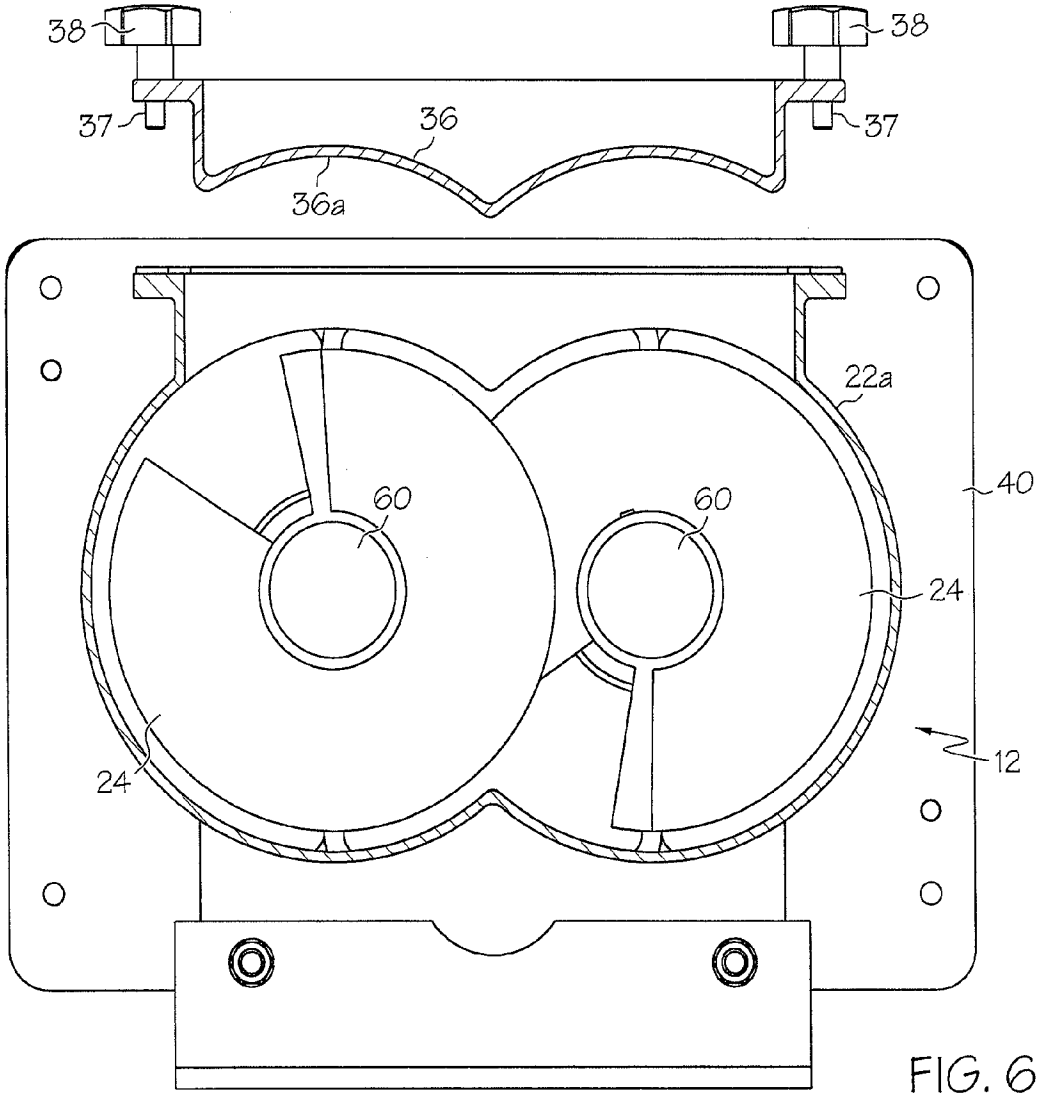
FIG. 6 is the side cross section of FIG. 5, with the hatch exploded away.

The extension portion 22*b* may include a removable cover or hatch 36 positioned on an upper side thereof. The hatch 36 (or its inner surface 36*a*) is contoured to match the profile of the extension portion 22*b* and/or the profile of the augers 24 received therein. Thus the hatch 36 (or its inner surface 36*a*) in end view may take the shape of two arcs or circle segments arranged end-to-end to allow the hatch 36 to conform to the augers 24 and provide the benefits described above. As shown in FIGS. 2 and 6, the hatch 36 may be removably coupled to the extension portion 22*b* by threaded fasteners 37 and associated hand knobs 38, although various other coupling mechanisms may be used. The hatch 36 can be removed to provide access to the augers 24, thereby enabling maintenance or repair of the augers 24, particularly in the extension portion 22*b*.

The downstream end of the extension portion 22*b* terminates in a flange 40. The flange 40 is attached to a corresponding flange 42 of an input section 44 of a suction housing 46 of the pump 14. The input section 44 may be generally rectangular in cross section, and may take the shape of a rectangle closely drawn around or through the "intersecting circle" cross section of the extension portion 22*b* of the auger housing 22. In particular, the cross section of one input section 44 is shown in hidden lines in FIG. 5. The input section 44 thus may have a cross sectional area that is at least as large as, or larger than, the cross sectional area of the auger housing 22/extension portion 22*b* such that there is no narrowing in a downstream direction all the way to the stator 50. This helps to reduce friction losses at the transition of the feeder assembly 12 and the pump 14, and increases efficiency, especially when highly viscous materials are being pumped. Moreover, a cross sectional area, which is easy to manufacture compared to a curved cross section, may be utilized for the input section 44 while still minimizing friction losses.

In this manner, since the input section 44 is at least as large as the extension portion 22*b*, a "bottleneck" area between the feeder assembly 12 and the pump 14, which would create pressure loss, is avoided. Moreover, since the input section 44 has a generally rectangular cross section (as opposed to, for example, circular), the cross sectional size and shape of the input section 44 closely matches (i.e. within about 10% by cross sectional area, in one case) the cross sectional size and shape of the extension portion 22*b* to provide for a smooth transition of the pumped materials into the pump 14/suction housing 46.

Thus, the pump 14 and feeder assembly 12 are specifically designed and formed to be utilized together, and the use of a transition piece or pieces to fluidly couple the pump 14 and the feeder assembly 12 are eliminated. The pump 14 and feeder assembly 12 may each be positioned on a wheeled pallet 45 to allow those components, and the system 10, to be maneuvered as desired. Moreover, by eliminating a transition piece, seams and other points of connection in the internal surface of the pump 14 are reduced.

It should also be noted that the input section 44 is integrally coupled to the suction housing 46. For example, the input section 44 may be permanently coupled to the suction housing 46 (i.e. by welding or the like) or may be formed as a unitary, one-piece molded item. Thus, the use of a unitary input section 44 and the elimination of a transition piece reduces the chances of leakage, eliminates seals and part count, and also creates a smooth inner surface which reduces/eliminates areas in which the pumped materials may be trapped to provide a sanitary transition between the feeder assembly 12 and the pump 14.

Figure 7:
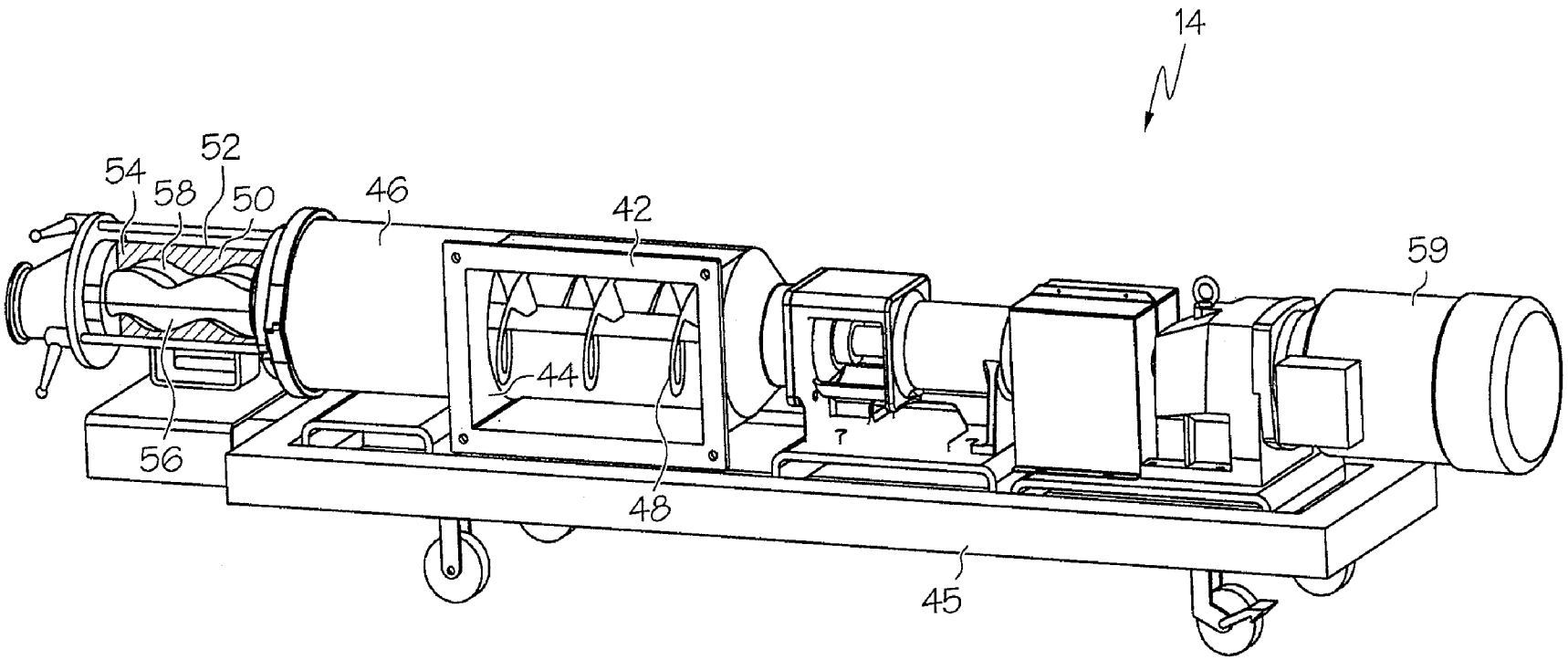
FIG. 7 is a front perspective view of the pump of the pump assembly of FIG. 1, with part of the pump shown in cross section.

The suction housing 46 may house an auger 48 therein (see FIG. 7). The downstream end of the suction housing 46 may be fully coupled to a stator 50 comprised of an outer, generally cylindrical stator tube or casing 52, and a stator liner 54 located therein. The stator liner 54 has an opening or internal bore extending generally longitudinally therethrough in the form of a double lead helical nut to provide an internally threaded stator 50. The pump 14 includes an externally threaded rotor 56 in the form of a single lead helical screw rotationally received inside stator 50. The rotor 56 may include a single external helical lobe, with the pitch of the lobe being twice the pitch of the internal helical grooves.

The rotor 56 fits within the stator 50 to provide a series of helical seal lines where the rotor 56 and stator 50 contact each other or come in close proximity to each other. In particular, the external helical lobe of the rotor 56 and the internal helical grooves of the stator 50 define the plurality of cavities 58 therebetween.

The rotor 56 is rotationally coupled to a motor 59 which drives the rotor 56 to rotate about its central axis and eccentrically rotate within the stator 50. As the rotor 56 turns within the stator 50, the cavities 58 progress from an inlet or suction end of the rotor/stator pair to an outlet or discharge end of the rotor/stator pair. During a single 360° revolution of the rotor 56, one set of cavities 58 is opened or created at the inlet end at exactly the same rate that a second set of cavities 58 is closing or terminating at the outlet end which results in a predictable, pulsationless flow of pumped fluid.

The pitch length of the stator 50 may be twice that of the rotor 56, and the present embodiment illustrates a rotor/stator assembly combination known as 1:2 profile elements, which means the rotor 56 has a single lead and the stator 50 has two leads. However, the present invention can also be used with any of a variety of rotor/stator configurations, including more complex progressing cavity pumps such as 9:10 designs where the rotor 56 has nine leads and the stator 50 has ten leads. In general, nearly any combination of leads may be used so long as the stator 50 has one more lead than the rotor 56. The operation, assembly and components of progressing cavity pumps are discussed in greater detail in U.S. Pat. Nos. 2,512,764, 2,612,845, 5,722,820, 6,120,267 and 6,491,501, the entire contents of which are incorporated herein by reference.

The hopper 16, ribbon auger 26, auger housing 22, augers 24, suction housing 46, auger 48, rotor 56 and stator 50, along with all of the surfaces to which the pumped materials are exposed (i.e. the wetted surfaces of the system 10) may be made of material appropriate for sanitary applications. For example, these surfaces may be made of a relatively hard, non-absorbent and easy to clean material, such as polished stainless steel or nearly any stainless, carbon or alloy steels.

Figure 8:
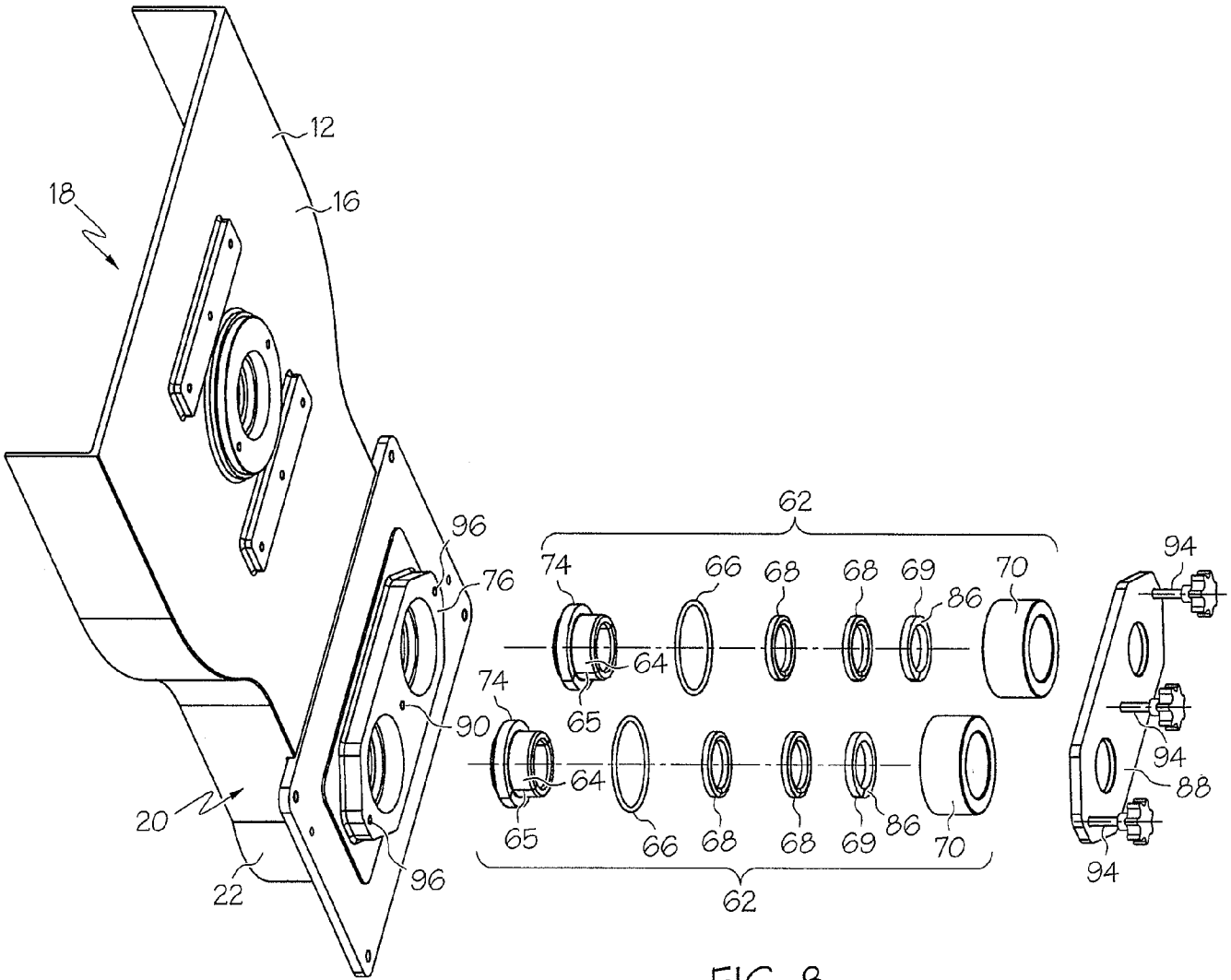
FIG. 8 is a perspective view of the end of the hopper of FIG. 3, with the seal assemblies being shown in exploded format.
Figure 9:
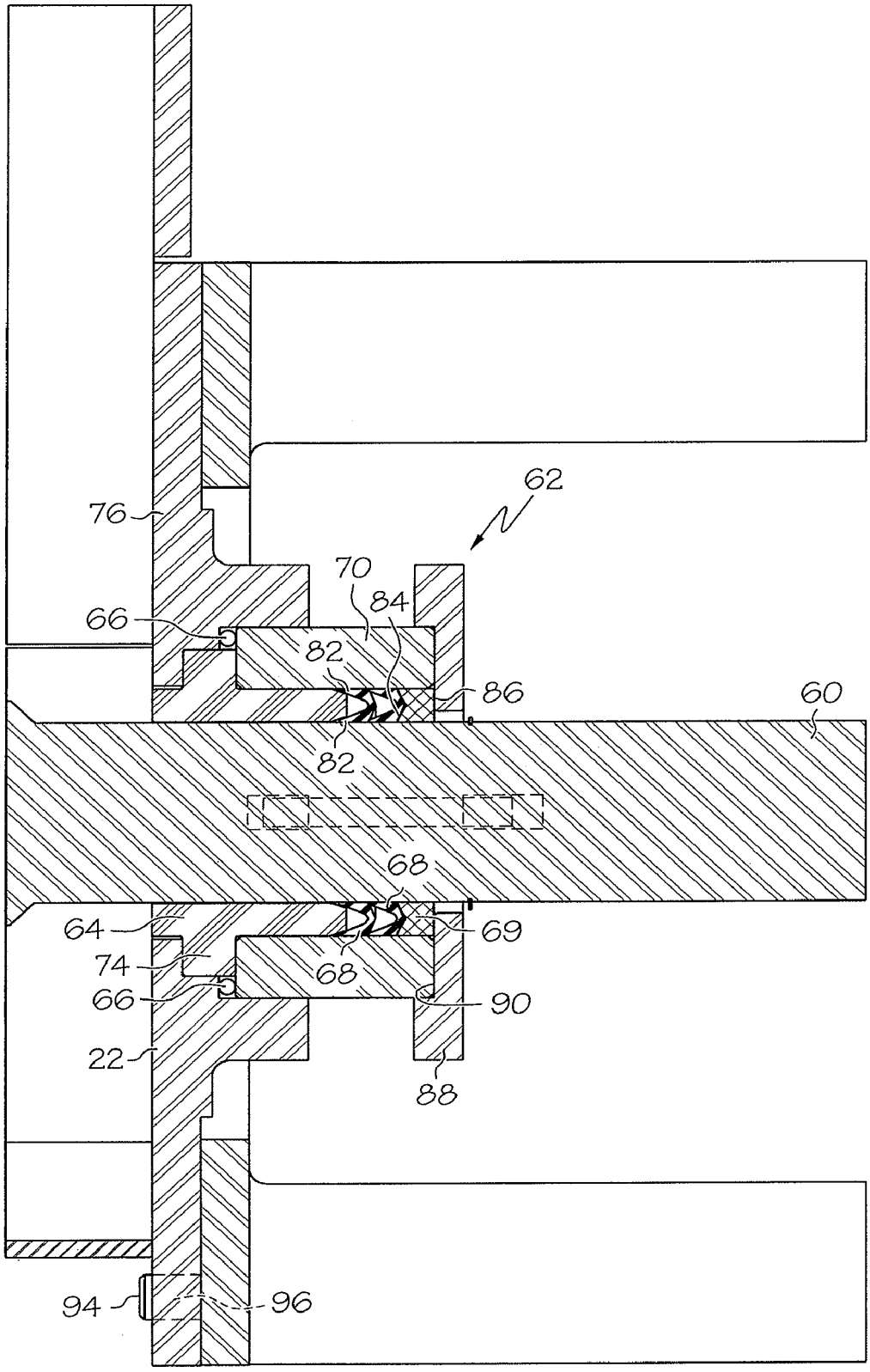
FIG. 9 is a side cross section of an assembled seal assembly.
Figure 10:
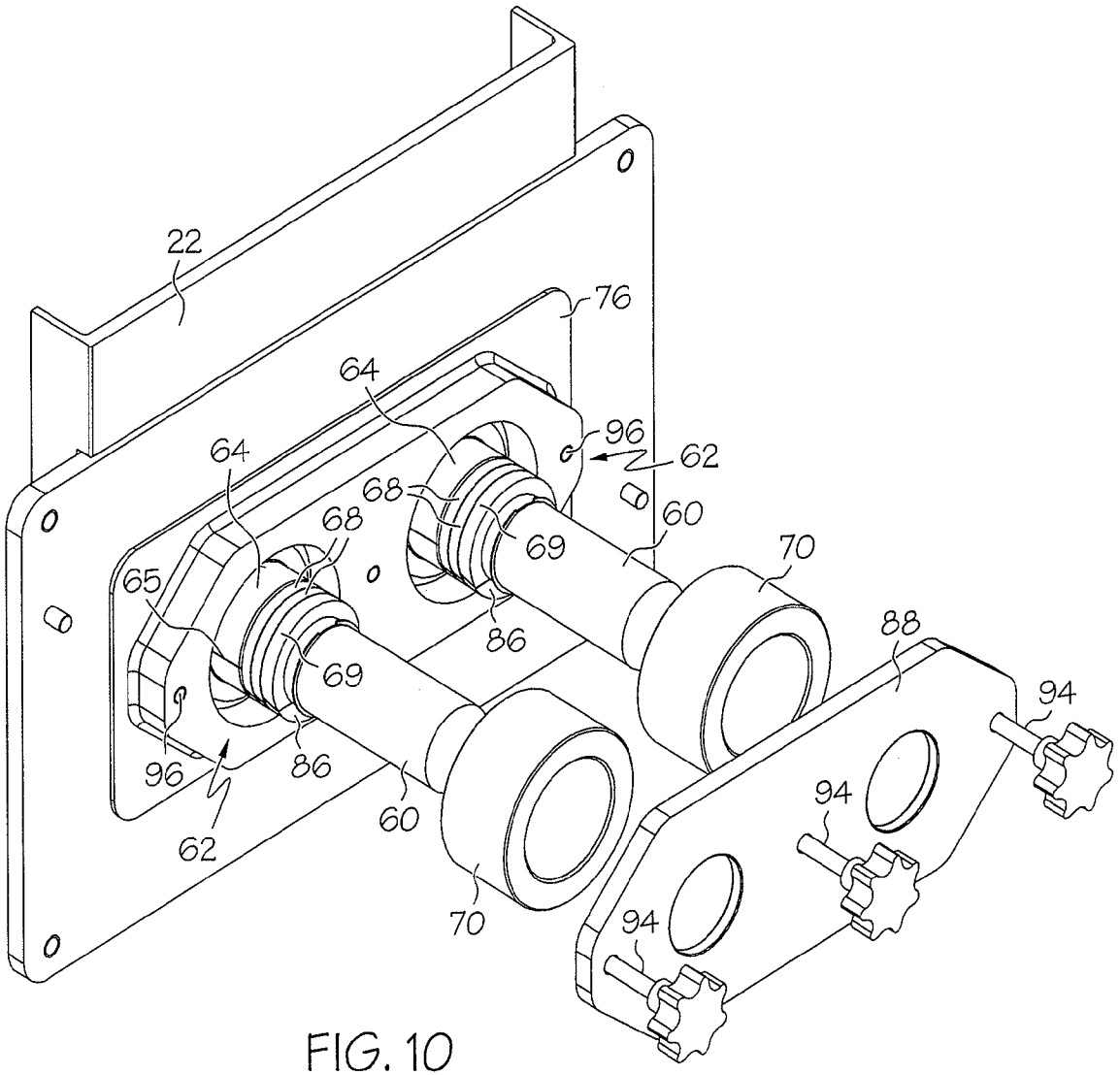
FIG. 10 is a perspective view of a pair of seal assemblies, with the mounting plate and cap moved away.

Each auger 24 may each have a shaft 60 that is journaled to the auger housing 22 using a seal assembly 62, as shown in FIGS. 8-10. In the illustrated embodiment, the seal assembly 62 includes a bushing 64, an o-ring 66, a set of three seals 68, 69, and a retainer, cap or packing gland 70. Each bushing 64 receives an auger shaft 60 therethrough (see FIG. 9). The bushings 64 are designed to bear the weight of the associated auger shaft 60, help seal the auger housing 22, and facilitate rotation of the auger shaft 60 (i.e. in place of bearings).

The bushings 64 can be made of a variety of materials, but may be made of a relatively compliant, high lubricity material. For example, in one embodiment the bushings 64 are made of DELRIN® synthetic resinous plastic material. The bushings 64 may be made of a sanitary material that is approved/appropriate for use in sanitary applications (i.e. FDA-approved materials). Each bushing 64 may have a flange 74 that abuts up against a mounting plate 76 that is part of or coupled to the auger housing 22. The bushings 64 may be split bushings 64 (i.e. each has a radially extending cut 65 entirely through its thickness).

Each o-ring 66 can be made of a variety of materials, such as material suitable for sanitary applications, including fluoroelastomers, VITON® synthetic rubber, or the like. Each o-ring 66 may be mounted on the flange 74 of the bushing 64.

Figure 11:
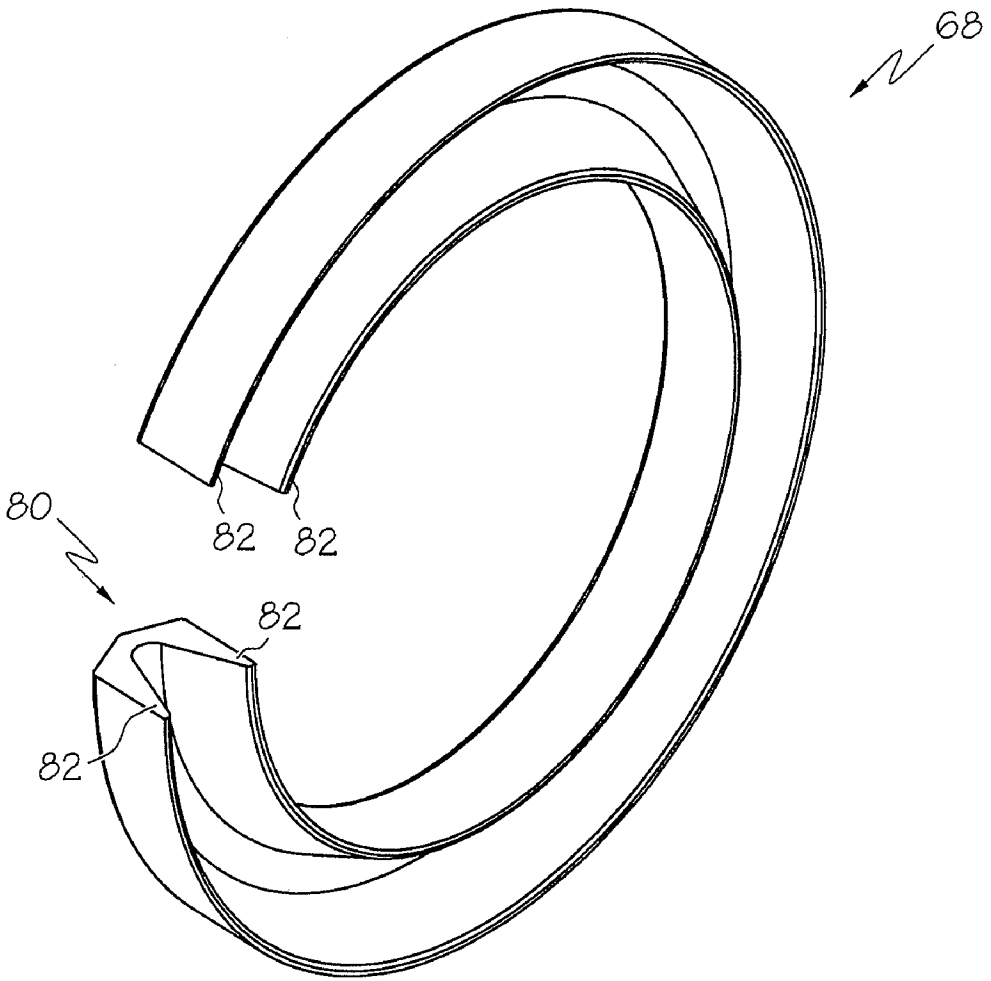
FIG. 11 is a perspective view of a seal of the seal assemblies of FIGS. 8-10.

The seals 68 are mounted adjacent to the end of the bushing 64. As shown in FIG. 11, the seals 68 each may have a generally "V" shape in cross section, and are also split at 80. In the illustrated embodiment, each seal 68 is split along a skewed angle; that is, along a plane that forms an angle with a radial plane of the seal 68. The skewed angle of the split 80 allows the seals 68 to be placed onto and removed from a shaft 60 easier due to the angled nature of the "cut" surfaces of the seal 68. The seals 68 can be made of any of a variety of materials, such as synthetic resinous fluorine-containing polymers, including as TEFLON® polymer or the like. The "V" shape of the seals 68 helps to seal the seal assembly 62. In particular, when the seal assembly 62 is placed in a state of compression, the outer ends 82 of the "V" shape of each seal 68 deflect outwardly and form a tight seal with the adjacent components.

The axially outer-most seal 69 may be made of the same materials as the seals 68, and also have a split. However, the seal 69 may be slightly concave on its axial inner surface 84 and generally flat on its axial outer surface 86 to correspond in shape to the adjacent seal 68 and clamp plate 88, respectively. Each seal 68, 69 may be rated to seal up to a certain pressure (i.e. 25 psi in one embodiment) so the number of seals 68, 69 can be adjusted as necessary to provide the desired sealing characteristics.

The cap or packing gland 70 fits over, and covers, the bushing 64, o-ring 66 and seals 68, 69 to provide mechanical protection to the seal assembly 62. A clamp plate 88 is positioned adjacent to the cap 70 and includes a pair of recesses 90 therein (i.e. circular recesses in the illustrated embodiment) to receive the distal end of the caps 70 therein and retain the caps 70 in place.

The clamp plate 88 receives a set of three knobbed threaded fasteners 94 therethrough, which are in turn threadably received in corresponding threaded holes 96 in the mounting plate 76 to secure the clamp plate 88 to the mounting plate 76. As the clamp plate 88 is secured in place by tightening the threaded fasteners 94, the clamp plate 88 and cap 70 compresses the bushing 64 and o-ring 66, along with the seals 68, 69. The cap 70 is sized to limit the compressive force that can be applied to the seals 68, 69 by the clamp plate 88 to place the seal assembly 62 in the desired state of compression. When properly compressed the ends 82 of the seals 68 can flare outwardly to form the desired seal, as described above.

Because the bushing 64 bears the weight of the auger shaft 60, the bushing 64 is a wear component that may need to be replaced over time. Accordingly, in order to access the bushing 64, the threaded fasteners 94 are unfastened, and the clamp plate 88 is moved along the auger shaft 66, away from the auger housing 22. The cap 70 is then moved along the auger shaft 60, away from the auger housing 22, exposing the bushing 64, o-ring 66 and seals 68, 69. Because the bushing 64 is a split bushing, the bushing 64 can then be removed off of the auger shaft 60 in a radial direction and replaced. If desired, the o-ring 66 and seals 68, 69 can also be removed or cleaned, and replaced. Once the bushing 64, o-ring 66 and seals 68, 69 are reassembled on the auger shaft 60 to form the seal assembly 62, the cap 70 is then slid along the auger shaft 60 to cover the seal assembly 62. The clamp plate 88 is threaded to the mounting plate 76 to place the seal assembly 62 back into the desired state of compression.

Because the bushing 64 and seals 68, 69 are all split components, those components can all be removed from and mounted onto the auger shaft 60 in a radial direction without being slid off of the end of the auger shaft 60. Moreover, although the o-ring 66 may not necessarily be split, if desired the o-ring 66 may be of a type which can be split (i.e. pulled apart) and reassembled by glue, other adhesives, or the like. Alternately, however, the o-ring 66 may not be split or reattachable, which may be acceptable since the o-ring 66 may not often need repair. Thus this arrangement provides significant advantages in that the entire seal assembly 62, or the replaceable/wear components of the seal assembly 62, can be removed and replaced, without having to disassemble the auger shaft 60. Instead, the seal assembly 62 can be accessed, removed and replaced while the auger shaft 60 remains in place.

Moreover, as best shown in FIG. 9, the seal assembly 62 is positioned generally entirely externally of the auger housing 22 and the bushing 64 may be generally flush with the wall of the auger housing 22 (i.e. the seal assembly 62 does not protrude into the auger housing 22). This arrangement helps to eliminate crevices and dead spaces in the auger housing 22, thereby improving the sanitary nature and cleanability of the auger housing 22. For example, if the seal assembly 62, and its various seals and components were to be positioned inside the auger housing 22, the seal assembly 62 could trap portions of the pumped material therein. The external mounting arrangement provides an effective sealing arrangement while presenting smooth internal surfaces, and prevents the pumped materials from escaping the auger housing 22.

The drawings described above show the use of a seal assembly 62 for journaling the shaft 60 of the augers 24 in the auger housing 22. However, if desired, the same seal assembly 62 described and shown herein may be used to journal the ribbon auger 26 to the hopper 16 in the same manner as described above, to provide the same advantages.

In the embodiment shown in FIGS. 1 and 2, the feeder assembly 12 is positioned generally perpendicular to the pump 14 to form an assembly 10 having a generally "T" shape. However, the feeder assembly 12 can be arranged is a variety of other configurations, such as generally parallel to the pump 14 and either co-planar with the pump 14 or suspended over the pump 14. Various other configurations, which can be used herein, are shown in U.S. Pat. No. 6,491,501.

Figure 12:
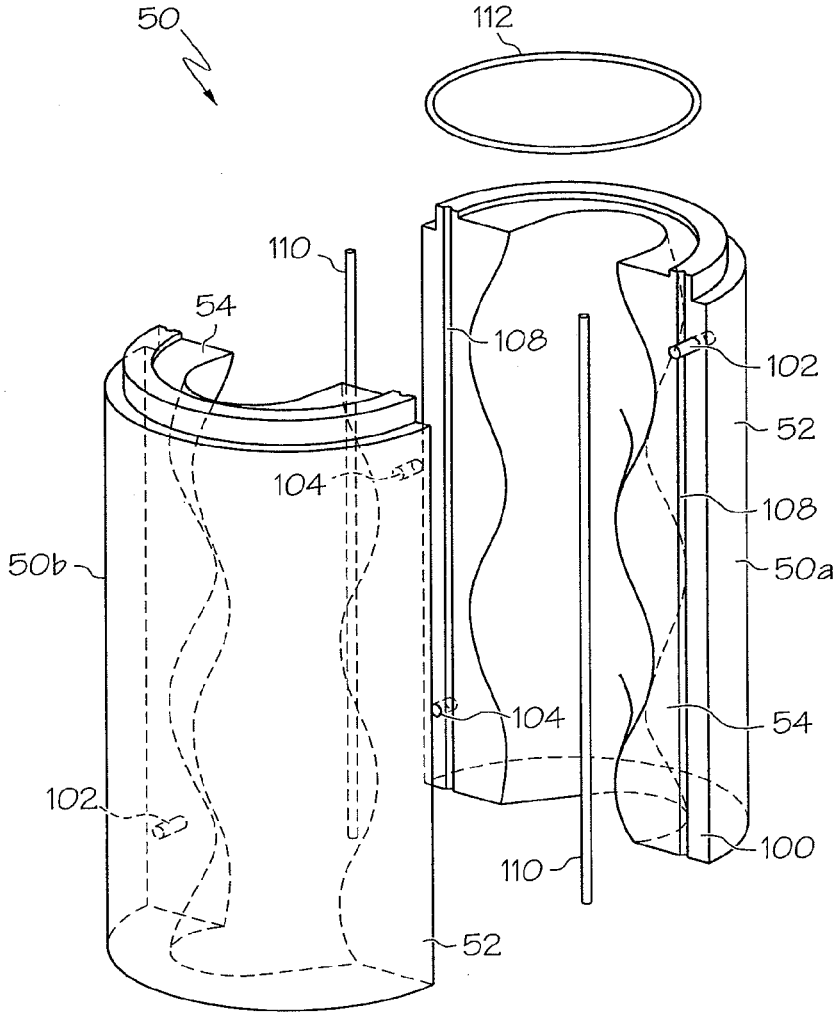
FIG. 12 is a perspective view illustrating a pair of exploded stator portions.

As shown in FIGS. 2 and 12, the stator 50 may be a split stator which is split into two stator portions 50*a*, 50*b* along its longitudinal axis. The split or seam 100 between the stator portions 50*a*, 50*b* may extend through the entire thickness of the stator 50; that is, from the outer (cylindrical) surface entirely through to its inner (helical) surface, and may extend the entire length of the stator 50. Each seam 100 may intersect or be positioned immediately adjacent to the inner surface of the stator 50, and the rotor 56 may simultaneously engage both stator portions 50*a*, 50*b*. The split nature of the stator 50 allows the stator 50 to be removed from the rotor 56/pump 14 without having to completely disassemble the pump 14, unthread the rotor 56, etc. Instead, in this case the stator 50/stator portions 50*a*, 50*b* can be easily removed in the radial direction (and without intersecting the central axis of the rotor/pump) which allow for easy access for repair, maintenance, etc. of the stator 50, rotor 56, and other pump components.

The split portions 50*a*, 50*b* can be aligned and coupled together by various structures and mechanisms such that the portions 50*a*, 50*b* abut against each other along generally axially-extending seams. In the embodiment of FIG. 12, each stator portion 50*a*, 50*b* includes a transversely extending peg 102 at one end and a correspondingly shaped opening 104 at its other end. Each peg 102 fits into a corresponding opening 104 on the other stator portion 50*a*, 50*b* to help align and couple the stator portions 50*a*, 50*b*. The pegs 102/openings 104 may be arranged such that the stator portions 50*a*, 50*b* can be assembled in only the appropriate configuration.

Moreover, in the illustrated embodiment each stator portion 50*a*, 50*b* includes a pair of opposed, axially-extending grooves 108. A sealing component 110 can be positioned in each groove 108 to help seal and align the stator portion 50*a*, 50*b* along the axial direction. The sealing component 110 can be made of a variety of materials, such as o-ring material (i.e. a hollow tube). If desired, each groove 108 may be slightly smaller in diameter than the sealing component 110 to ensure the sealing components 110 form an appropriate seal. An o-ring 112 may also be positioned at each axial end of the stator 50. The o-ring 112 and sealing components 110 may be made of the same material as the o-rings 66 discussed above in the context of the seal assembly 62.

Figure 13:
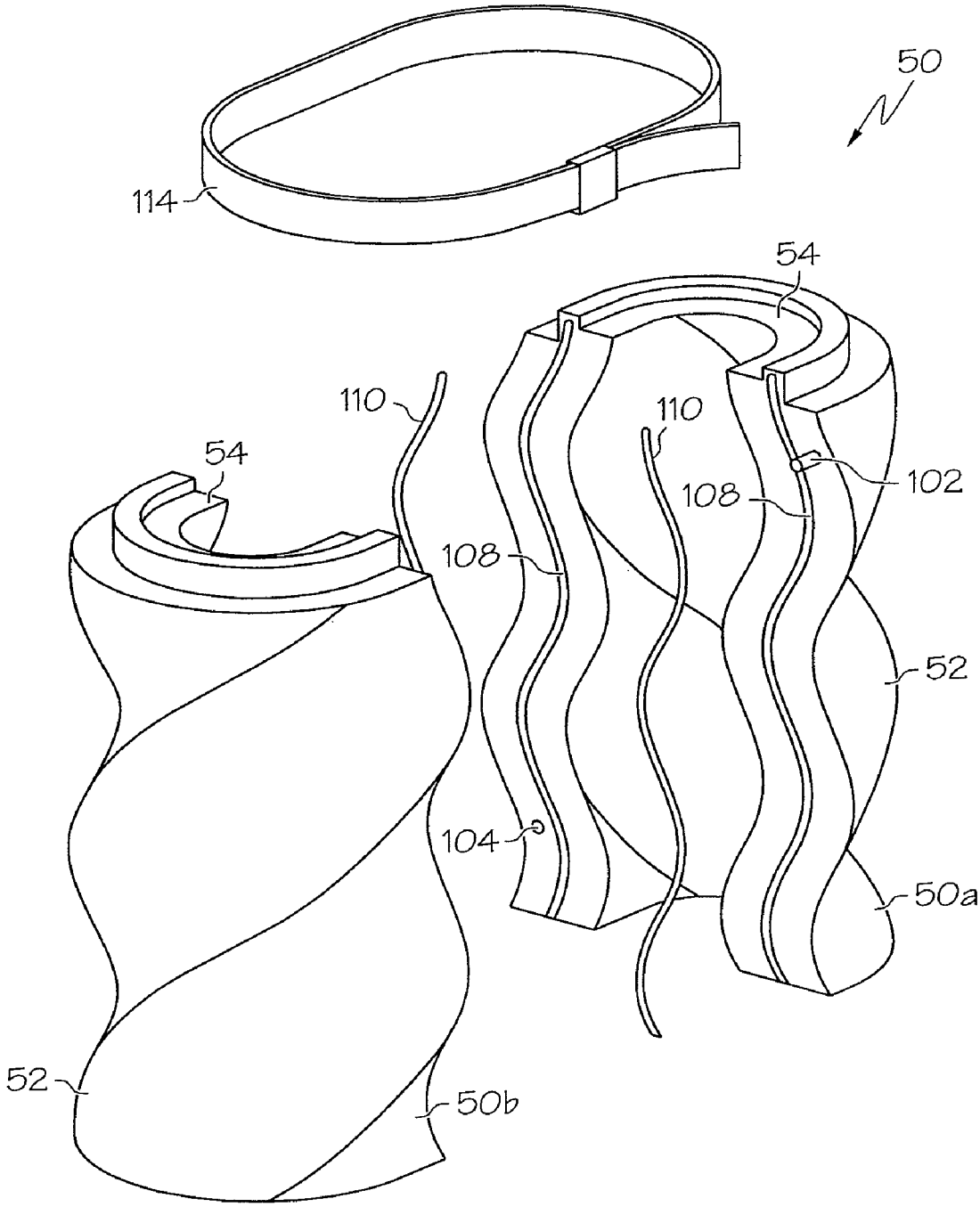
FIG. 13 is a perspective view illustrating a pair of exploded stator portions of an equal wall stator.

Various clamps, rings, and the like can be positioned about the periphery of the stator 50 to keep the stator portions 50*a*, 50*b* in place. For example, as shown in FIG. 13 a clamp or belt (or multiple clamps or belts (not shown)) 114 may extend around the stator portions 50*a*, 50*b*, and be attached to itself to form a loop that presses the stator portions 50*a*, 50*b* together. The use of clamps, rings and the like also help to press the internal faces of the stator portions 50*a*, 50*b* together to form a tight seal therebetween along the length of the split 100. The clamps, rings and the like may be positioned at the axial ends of the stator 50, although intermediate clamps, rings and the like may also be used.

The nature of the split stator 50 can be exploited to address jamming or clogs in the pump 14. In particular, in the event of a jam or clog, the clamps, rings and the like compressing the stator portions 50*a*, 50*b* together may be loosened, thereby allowing the split portions 50*a*, 50*b* to move radially outwardly which can allow unusually large masses to pass through the stator 50. Once the large mass has passed through, the clamps, rings and the like may be tightened back down. This procedure can be utilized to enable quick servicing of the pump 14 without disassembly. Alternately, the state of compression of the stator portions 50*a*, 50*b* can be adjusted (i.e. loosened) and left in that state to correspondingly adjust the pump characteristics.

In the illustrated embodiment the stator 50 is split by a plane extending through its central axis to provide two equally-sized (i.e. 180°) stator portions 50*a*, 50*b*. However, if desired the stator 50 can be split in other configurations such that the stator portions 50*a*, 50*b* are not equally sized (i.e. a 150° portion and a 210° portion). Moreover, if desired, multiple splits may be provided such that the stator 50 is split into three, four, or more stator portions. These variations may be useful if there are structures surrounding or immediately adjacent to the pump 14 that may hinder access. In this case the stator portions can be configured such that the stator portions can be lifted radially away from the pump 14 in a manner that avoids the surrounding structures.

As noted above, the stator 50 can be made of metals or relative rigid materials, which may be useful for sanitary applications. In this case, the entire stator 50 is made of single type of material throughout its thickness (i.e. there may not be a distinct stator tube 52 and stator liner 54). However, if desired, a stator tube 52, which can be made of metal or the like, may be provided, and a softer inner stator material or stator liner 54 (which defines the helical inner surface) is received in the stator tube 52. In this case the stator tube 52 and stator liner 54 are both split through their entire thickness, as shown in FIG. 12.

The stator liner 54 can be any of a variety of materials, silicone, plastic, durameter rubber, nylon, elastomers, nitrile rubber, natural rubber, synthetic rubber, fluoroelastomer rubber, urethane, ethylene-propylene-diene monomer ("EPDM") rubber, polyolefin resins, perfluoroelastomer, hydrogenated nitriles and hydrogenated nitrile rubbers, polyurethane, epichlorohydrin polymers, thermoplastic polymers, polytetrafluoroethylene ("PTFE"), polychloroprene (such as Neoprene), synthetic elastomers such as HYPALON® polyolefin resins and synthetic elastomers sold by E. I. du Pont de Nemours and Company located in Wilmington Del., synthetic rubber such as KALREZ® synthetic rubber sold by E. I. du Pont de Nemours and Company, tetrafluoroethylene/propylene copolymer such as AFLAS® tetrafluoroethylene/propylene copolymer sold by Asahi Glass Co., Ltd. of Tokyo, Japan, acid-olefin interpolymers such as CHEMROZ® acid-olefin interpolymers sold by Chemfax, Incorporated of Gulfport Miss., and various other materials.

Figure 14:
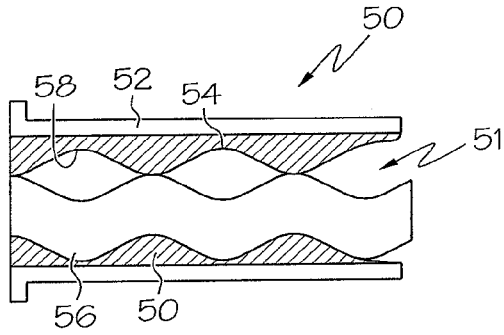
FIG. 14 is a side cross section of another embodiment of the stator of the present invention.

As shown in FIG. 14, the inlet/suction end 51 of the stator opening may be flared outwardly (i.e. increasing its cross-sectional area) to allow the stator opening accommodate the material to be pumped as it enters the stator 50. In particular, the inlet end 51 of the stator opening may be generally circular in cross section to maximize the size of the inlet end 51 of the stator opening. The stator opening may then transition to the helical shape relatively rapidly (i.e. within about 5%, or about 10%) of the length of the stator 50 to ensure that significant pumping pressures are not sacrificed.

Although the stator casing 52 shown in FIG. 12 has a generally cylindrical outer surface, as shown in FIG. 13 the stator casing 52 may have a helical outer (and inner) surface such that the stator casing 52, and the stator 50 as a whole, is an equal-wall or constant thickness stator. This equal-thickness wall stator 50 can be split into stator portions 50*a*, 50*b* in the same manner described above and provide the same or similar benefits, and the stator portions 50*a*, 50*b* may be coupled together by a belt, clamp or the like 114.

Having described the invention in detail and by reference to the preferred embodiments, it will be apparent that modifications and variations thereof are possible without departing from the scope of the invention.

What is claimed is:

1. A progressing cavity pump system comprising:

a feeder assembly including a hopper for receiving material to be pumped therein, said feeder assembly including an auger housing receiving an auger therein, said auger housing having an underlying portion positioned generally below said hopper and having a radial opening open to said hopper, and an extension portion which is generally radially closed, said extension portion and said underlying portion being of a one-piece, seamless construction; and a progressing cavity pump including a rotor, a stator, an inlet and an outlet, said rotor being rotationally disposed inside said stator such that rotation of said rotor causes material in said pump to be pumped from said inlet toward said outlet, wherein said inlet is fluidly coupled to said extension portion and wherein said auger housing receives a supplemental auger therein and positioned generally adjacent to and parallel with said auger, and wherein said extension portion, in cross section, has a shape generally corresponding to two spaced apart, intersecting circles to closely conform to said augers.

2. The system of claim 1 wherein said extension portion is fluidly coupled to said inlet and wherein there is no area of narrowing in a downstream direction between said extension portion and said stator.

3. The system of claim 1 wherein said input section and said extension portion have generally the same cross sectional size and shape to provide a smooth transition between said feeder assembly and said pump.

4. The system of claim 1 wherein said extension portion is generally not positioned directly below said hopper.

5. The system of claim 1 wherein said auger includes a central shaft, and wherein the feeder assembly further includes a seal assembly positioned adjacent to said auger housing to seal said auger housing about said auger shaft, said seal assembly being generally positioned externally of said auger housing.

6. The system of claim 1 wherein said auger includes a central shaft, and wherein the feeder assembly further includes a seal assembly positioned adjacent to said auger housing and on said central shaft to seal about said auger shaft relative to said auger housing, said seal assembly including a bushing, said bushing being a split bushing to allow placement on and removal from said central shaft in a radial direction.

7. The system of claim 6 wherein said seal assembly includes a seal positioned adjacent to said bushing, said seal being a split seal to allow placement on and removal from said central shaft in a radial direction.

8. The system of claim 7 wherein said seal is generally "V" shaped in cross section.

9. The system of claim 8 wherein said seal assembly further includes a supplemental seal positioned immediately adjacent to said seal.

10. The system of claim 1 wherein generally all wetted surfaces of said feeder assembly and said pump are made of stainless steel, or carbon or alloy steels, or combinations thereof, to provide a sanitary pump system.

11. The system of claim 1 wherein said stator includes at least two separable radial stator portions.

12. The system of claim 1 wherein said extension portion and said underlying portion are made of a single, unitary piece of material lacking any seams on an inner surface thereof.

13. The system of claim 1 wherein said extension portion is directly fluidly coupled to said inlet.

14. The system of claim 1 further including a hatch to provide access to an inner cavity thereof, said hatch being removably mounted to said extension portion, wherein said hatch has an inner surface generally matching the contour of the remaining inner surface of said extension portion.

15. The system of claim 1 wherein said auger and said supplemental auger extend through generally an entire length of said extension portion.

16. The system of claim 1 wherein an inner surface of said extension portion has a shape generally corresponding to two spaced apart, intersecting circles.

17. A progressing cavity pump system comprising:

a feeder assembly including a hopper for receiving therein material to be pumped, said feeder assembly including an auger housing receiving an auger therein, said auger housing having an underlying portion positioned generally below said hopper and having a radial opening open to said hopper, and an extension portion which is generally radially closed, said extension portion and said underlying portion being of a one-piece, seamless construction; and a progressing cavity pump including a rotor, a stator, an inlet and an outlet, said rotor being rotationally disposed inside said stator such that rotation of said rotor causes material in said pump to be pumped from said inlet toward said outlet, wherein said inlet is fluidly coupled to said extension portion, the system further including a hatch to provide access to an inner cavity thereof, said hatch being removably mounted to said extension portion, wherein said hatch has an inner surface generally matching the contour of the remaining inner surface of said extension portion.

18. The system of claim 17 wherein said inner surface of said hatch is generally curved.

19. The system of claim 17 wherein said inner surface of said hatch generally has a shape corresponding to two adjacent arcs.

20. The system of claim 17 wherein said wherein said auger housing receives a supplemental auger therein which intermeshes with said auger.

21. The system of claim 17 wherein said system is configured such that a cross sectional area of a fluid path between said extension portion and said stator is not decreased at any point along said fluid path in said downstream direction.

22. The system of claim 17 wherein said input section has an inlet and an outlet having a cross sectional area at least as large as said inlet.

23. The system of claim 17 wherein generally all wetted surfaces of said feeder assembly and said pump are made of stainless steel, or carbon or alloy steels, or combinations thereof, to provide a sanitary pump system.

24. The system of claim 17 wherein said wherein said auger housing receives a supplemental auger therein and positioned generally adjacent to and parallel with said auger, and wherein said extension portion, in cross section, has a shape generally corresponding to two spaced apart, intersecting circles to closely conform to said augers.

25. The system of claim 17 wherein said extension portion and said underlying portion are made of a single, unitary piece of material lacking any seams on an inner surface thereof.

26. The system of claim 17 wherein said auger extends through generally an entire length of said extension portion.

* * * * *